US008950154B1

(12) United States Patent
Casey

(10) Patent No.: US 8,950,154 B1
(45) Date of Patent: Feb. 10, 2015

(54) SR THERMAL BREAK DEVICE AND METHOD OF USE

(76) Inventor: Scott William Casey, Cascade, IA (US)

( * ) Notice: Subject to any disclaimer, the term of this patent is extended or adjusted under 35 U.S.C. 154(b) by 0 days.

(21) Appl. No.: 13/494,133

(22) Filed: Jun. 12, 2012

Related U.S. Application Data

(60) Provisional application No. 61/571,089, filed on Jun. 21, 2011.

(51) Int. Cl.
*E04C 2/38* (2006.01)

(52) U.S. Cl.
USPC ..... 52/717.05; 52/717.02; 49/483.1; 49/489.1

(58) Field of Classification Search
USPC ..... 52/309.9, 717.02, 717.01, 717.03, 52/717.04, 717.05, 411, 373; 404/47, 49; 49/467, 468, 469, 470, 471, 475.1, 49/476.1, 479.1, 483.1, 489.1, 493.1, 49/498.1, 499.1
See application file for complete search history.

(56) References Cited

U.S. PATENT DOCUMENTS

| | | | | | |
|---|---|---|---|---|---|
| 2,111,114 | A | * | 3/1938 | Fisher | 404/67 |
| 2,431,385 | A | * | 11/1947 | Fischer | 404/49 |
| 3,023,681 | A | * | 3/1962 | Worson | 404/49 |
| 3,334,558 | A | * | 8/1967 | Atkinson | 404/87 |
| 3,899,260 | A | * | 8/1975 | Kerschner | 404/64 |
| 3,960,462 | A | * | 6/1976 | Kerschner | 277/644 |
| 4,061,272 | A | * | 12/1977 | Winston | 405/45 |
| 4,184,298 | A | * | 1/1980 | Balzer et al. | 52/396.05 |
| RE31,283 | E | * | 6/1983 | Puccio | 404/68 |
| 4,388,016 | A | * | 6/1983 | Levey | 404/48 |
| 4,490,067 | A | * | 12/1984 | Dahowski | 404/4 |
| 4,784,516 | A | * | 11/1988 | Cox | 404/69 |
| 4,824,283 | A | * | 4/1989 | Belangie | 404/64 |
| 5,269,624 | A | * | 12/1993 | Kramer | 404/64 |
| 5,487,250 | A | * | 1/1996 | Yount et al. | 52/417 |
| 5,628,159 | A | * | 5/1997 | Younts | 52/417 |
| 5,791,111 | A | * | 8/1998 | Beenders | 52/396.05 |
| 5,908,266 | A | * | 6/1999 | Miller | 405/41 |
| 5,935,695 | A | * | 8/1999 | Baerveldt | 428/218 |
| 6,039,503 | A | * | 3/2000 | Cathey | 404/67 |
| 6,061,967 | A | * | 5/2000 | Judds | 49/469 |
| 6,112,488 | A | * | 9/2000 | Olson et al. | 52/393 |
| 6,295,763 | B1 | * | 10/2001 | Serba | 49/468 |
| 6,484,447 | B1 | * | 11/2002 | Snyder et al. | 49/499.1 |
| 6,491,468 | B1 | * | 12/2002 | Hagen | 403/291 |
| 6,655,440 | B2 | * | 12/2003 | Brunk | 160/40 |
| 6,662,518 | B1 | * | 12/2003 | Devereux | 52/716.1 |
| 6,739,805 | B2 | * | 5/2004 | Shotton | 405/267 |
| 6,751,918 | B2 | * | 6/2004 | Jesko | 52/393 |
| 6,751,919 | B2 | * | 6/2004 | Calixto | 52/573.1 |
| 6,763,637 | B2 | * | 7/2004 | Pelosi, Jr. | 52/181 |
| 6,994,144 | B2 | * | 2/2006 | Fletcher | 160/209 |
| 7,143,560 | B2 | * | 12/2006 | Jesko | 52/395 |
| 7,174,682 | B2 | * | 2/2007 | Pelosi, Jr. | 52/179 |
| 7,354,219 | B2 | * | 4/2008 | Leonberg | 404/58 |
| 7,437,855 | B2 | * | 10/2008 | Locke et al. | 52/169.14 |

(Continued)

*Primary Examiner* — James Ference
(74) *Attorney, Agent, or Firm* — Tipton L. Randall

(57) ABSTRACT

A thermal break device minimizes the transfer of heat from a building with a concrete slab floor. The thermal break device comprises a hollow conduits fabricated from a synthetic polymeric material. An insulating material completely fills the hollow conduit. The insulating material comprises a polymeric foam material. A weatherstrip seal is secured to a top surface of the thermal break device. The thermal break device is positioned within a concrete slab across an opening for an entry door such that the closed door contacts the weatherstrip seal of the thermal break device.

5 Claims, 4 Drawing Sheets

(56) References Cited

U.S. PATENT DOCUMENTS

| | | | | |
|---|---|---|---|---|
| 7,744,307 | B2 * | 6/2010 | Moor et al. | 404/75 |
| 2002/0009585 | A1 * | 1/2002 | Albert et al. | 428/315.7 |
| 2002/0112444 | A1 * | 8/2002 | Lacasse | 52/784.13 |
| 2002/0157338 | A1 * | 10/2002 | Jesko | 52/396.04 |
| 2005/0086868 | A1 * | 4/2005 | Santelli, Jr. | 49/499.1 |
| 2005/0223647 | A1 * | 10/2005 | Stutzman et al. | 49/499.1 |
| 2006/0000174 | A1 * | 1/2006 | Edgman | 52/396.02 |
| 2006/0005470 | A1 * | 1/2006 | Mullen et al. | 49/467 |
| 2008/0219766 | A1 * | 9/2008 | Edgman | 404/75 |
| 2008/0247822 | A1 * | 10/2008 | Moor et al. | 404/74 |
| 2009/0199978 | A1 * | 8/2009 | Crider et al. | 160/133 |
| 2010/0064590 | A1 * | 3/2010 | Jones et al. | 49/469 |
| 2010/0095620 | A1 * | 4/2010 | Wilkes, Jr. | 52/396.04 |

* cited by examiner

SR THERMAL BREAK DEVICE AND METHOD OF USE

CROSS-REFERENCE TO RELATED APPLICATIONS, IF ANY

This application claims the benefit under 35 U.S.C. §119 (e) of provisional application Ser. No. 61/571,089, filed 21 Jun. 2011. Application Ser. No. 61/571,6089 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to building construction and, more particularly, to a device used to prevent movement of heat from the interior to the exterior of a building and, most particularly, to a thermal break device used to minimize movement of heat from a building having a concrete floor to the exterior of a building.

2. Background Information

Many commercial buildings are provided with concrete floors to accommodate various vehicles used to move goods into and out of the building. Various types of doors are provided to control entry and exit to the building interior. Numerous residential dwellings include a garage with a concrete floor designed to hold one, two, three or more vehicles. Such garages are provided with an overhead door to control entry and exit to the garage. Both commercial buildings and residential garages are often heated, particularly in temperate climates. Because concrete is a good conductor of heat, the concrete floor within the door opening provides a conductive route for transferring heat from the interior of the building to the outside. Insulated garage doors and other overhead doors are commonly used to reduce heat loss from the interior of such buildings. However, the concrete floor extending through the door opening remains a conductive route for heat transfer.

Thus, there is an unmet need for a device and method for minimizing the transfer of heat from the interior of a building through the concrete floor located within door openings of that building.

Applicant has devised a thermal break device and a method of using the thermal break device for minimizing the transfer of heat from the interior of a building through the concrete floor located within door openings of that building.

SUMMARY OF THE INVENTION

The invention is a thermal break device minimizing the transfer of heat from a building with a concrete slab floor. The thermal break device comprises a hollow, square conduit fabricated from a synthetic polymeric material. An insulating material completely fills the hollow conduit. The insulating material comprises a polymeric foam material. A weatherstrip seal is secured to a top surface of the thermal break device. The thermal break device is positioned within a concrete slab across an opening for an entry door such that the closed door contacts the weatherstrip seal of the thermal break device.

DESCRIPTION OF THE EMBODIMENTS

Nomenclature

Figure 1:
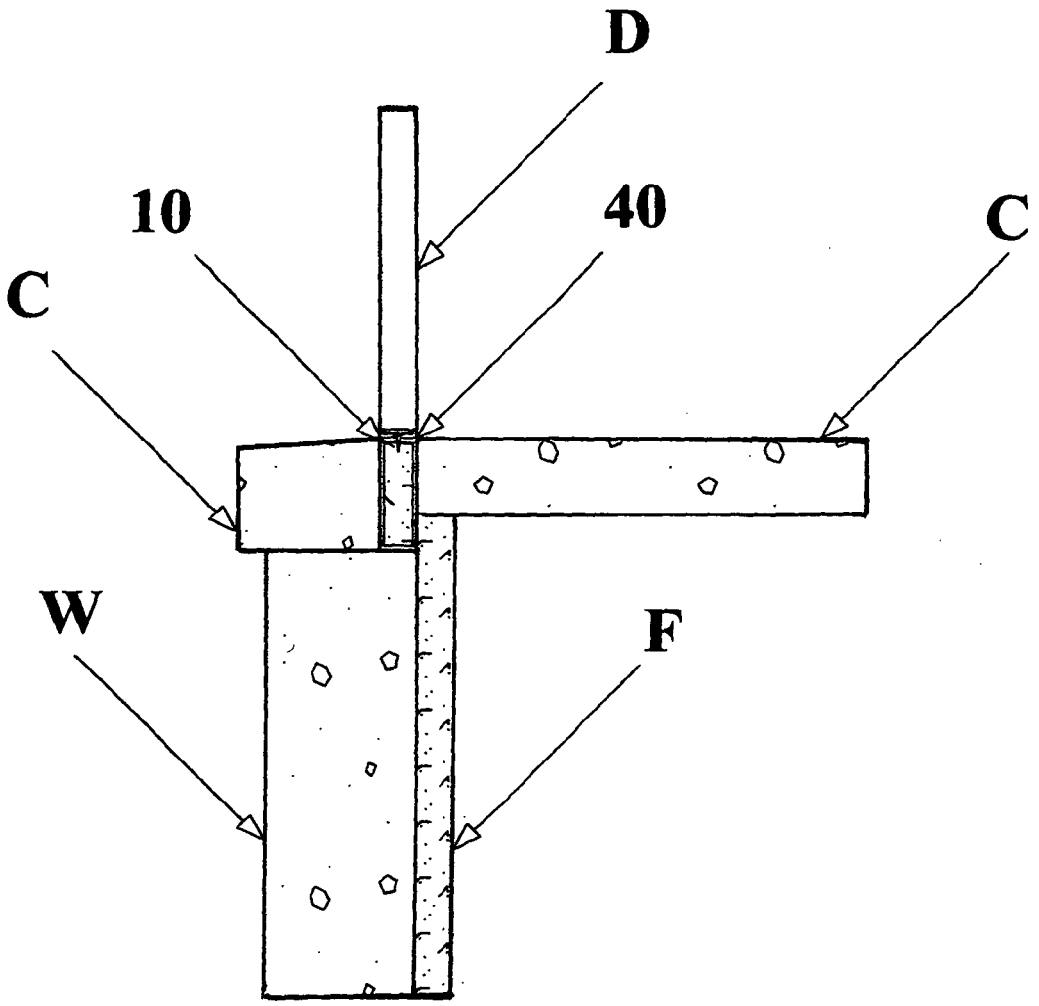
FIG. 1 is a sectional view of the SR thermal break device of the present invention installed across the opening for a garage door in a garage.

10 Thermal Break Device
20 Hollow Conduit
22 Top Wall of Hollow Conduit
24 Side Walls of Hollow Conduit
26 Bottom Wall of Hollow Conduit
30 Insulating Material
40 Weatherstrip Seal
45 Fastener for Weatherstrip Seal
C Concrete Slab
D Garage Door
F Foam Sheeting
H Header for Door
S Stud Wall
W Frost Wall

Construction

The invention is a thermal break device, used in building construction. The SR thermal break device comprises a plastic, foam-filled tube that is installed during the pouring of a building or garage slab. The SR thermal break tube device is installed with the top edge flush with top of concrete. In the application for a garage, the device is installed directly underneath the overhead door or slightly toward the outside of the door. The function of the SR thermal break device is to stop, or at least slow, the conduction of heat from the inside of a heated building or garage, to the outside. The SR thermal break device also slows the penetration of cold from the outside to the inside of a building. Concrete is a solid material, which makes a fairly good conductor of heat.

In typical building details, a concrete slab is poured through, for example, the garage door opening and extends several inches beyond the opening for the overhead door. Because concrete is conductive, heat from inside the building moves readily to the outside through the concrete under the door, even with the overhead door closed. The SR thermal break device includes a tube or conduit that is fabricated from a synthetic polymeric resin or plastic. Examples of such polymeric resins include polyvinyl chloride, polycarbonate, or fiberglass resin material. The tube or conduit is filed with a foam material having high insulation properties. The foam filled tube or conduit is much less conductive of heat, and functions as a thermal break, greatly slowing the transfer of heat to the outside of the building. The thermal break feature of the present invention is extremely important and highly effective for a building with a concrete slab constructed with infloor, radiant tube heating.

Thermodynamics teaches that heat moves from a warm area to a cold area, and that the larger the temperature differential between the two areas, the faster the movement. Therefore, in a radiant tube heated concrete slab, the higher the temperature of the heated slab, the more quickly heat moves to the outside due to the large temperature differential.

The SR thermal break device is available in various lengths and sizes as required by the customer and their specific needs. The SR thermal break device is installed before the concrete slab is poured, and also functions as a screed support to help maintain the proper concrete height, thereby providing a more consistent concrete surface upon which the door of the building closes.

Thermal conductivity or K-Value: Thermal conductivity is the quantity of heat transmitted through a unit thickness of material in a direction normal to a surface of unit area, due to a unit temperature gradient under steady state conditions. The larger the thermal conductivity value, the more conductive is the material. Stone concrete typically has a thermal conductivity value of 1.7, whereas polymeric resins or plastics have a thermal conductivity value of 0.1 to 0.22. Polyurethane foam has a thermal conductivity value of 0.02. A conduit or tube fabricated from plastic and filled with a typical spray polyurethane foam is approximately 75 times less conductive than is stone concrete.

Figure 2:
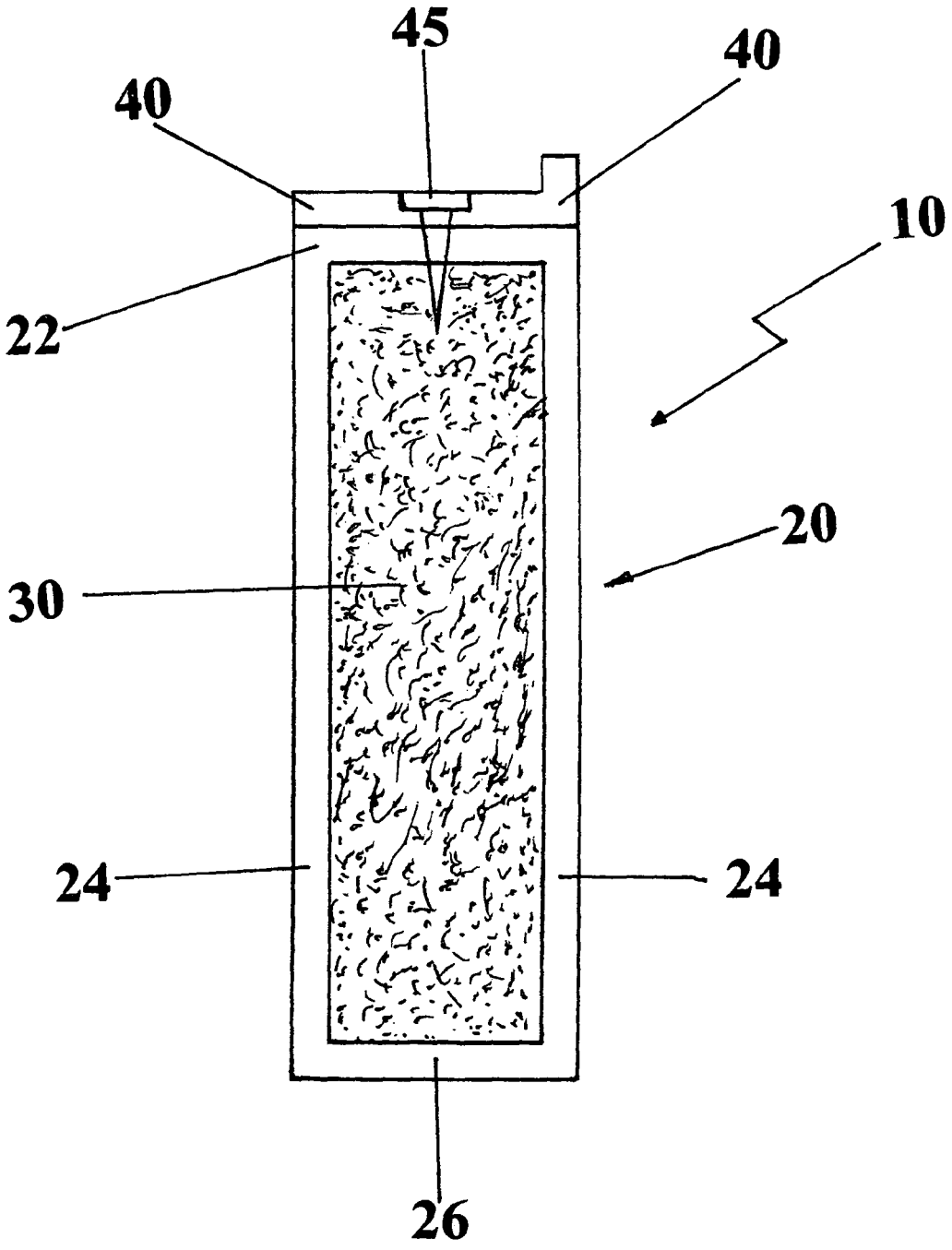
FIG. 2 is a sectional view of a first embodiment of the SR thermal break device of the present invention.

Referring now to FIG. 1, a sectional view of a first embodiment of the SR thermal break device 10 of the present invention installed across the opening for an overhead door D in a garage is shown. The SR thermal break device 10 is installed such that the garage door D contacts the SR thermal break device 10 when the door D is closed. Preferably, a weatherstrip seal 40 is fastened to the exposed, top surface 22 of the SR thermal break device 10 with fasteners 45, as illustrated in FIG. 2. The weatherstrip seal 40 provides a tight seal with the garage door D to minimize air flow under the closed garage door D. The concrete slab C of the garage is shown with a frost wall W fitted with foam sheeting F to further insulate the interior of the garage from loss of heat.

FIG. 2 provides a sectional view of the first embodiment of the SR thermal break device 10 of the present invention. The SR thermal break device 10 comprises a hollow conduit 20 fabricated from a synthetic polymeric material. In FIG. 2, the hollow conduit 20 is rectangular, although other shapes, such as cylindrical, provide comparable results. The hollow conduit 20 of FIG. 2 has a top wall 22, vertical side walls 24 and a bottom wall 26. Preferably, the synthetic polymeric material is selected from the group, polyvinyl chloride, polycarbonate, fiberglass reinforced resin, and polyester. An insulating material 30 completely fills the hollow conduit 20 of the SR thermal break device 10. Preferably, the insulating material 30 comprises a polymeric foam material, such as polystyrene foam or polyurethane foam, although other insulating materials 30 can provide equivalent performance.

Preferably, a weatherstrip seal 40 is secured to the top wall 22 of the hollow conduit 20 of the SR thermal break device 10. The weatherstrip seal 40 is secured to the top wall 22 by means of a number of fasteners 45. The SR thermal break device 10 is positioned within a concrete slab C across an opening for an entry door D such that the closed door D contacts the weatherstrip seal 40 of the SR thermal break device 10.

Alternatively, the weatherstrip seal 40 is secured to the bottom surface of the overhead entry door D and contacts the top surface 22 of the SR thermal break device 10 upon closing of the overhead entry door D.

Figure 3B:
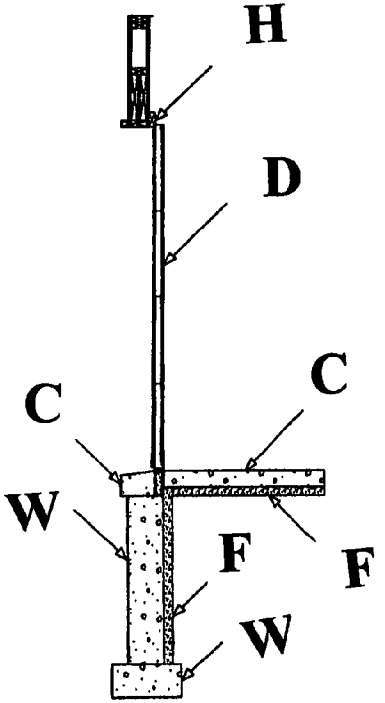
FIG. 3*b* is a sectional view of the garage foundation and floor containing the SR thermal break device of the present invention, the garage door and the garage door header there above.
Figure 3A:
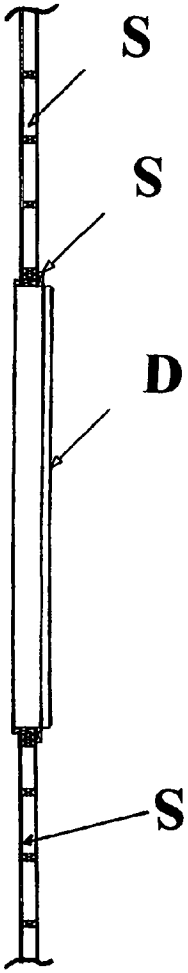
FIG. 3*a* is a top view of a garage door installed in a garage wall directly above the SR thermal break device of the present invention.

FIGS. 3*a* and 3*b* provide a top view and a sectional view, respectively, of the SR thermal break device 10 upon closing of an overhead garage door D.

Figure 4:
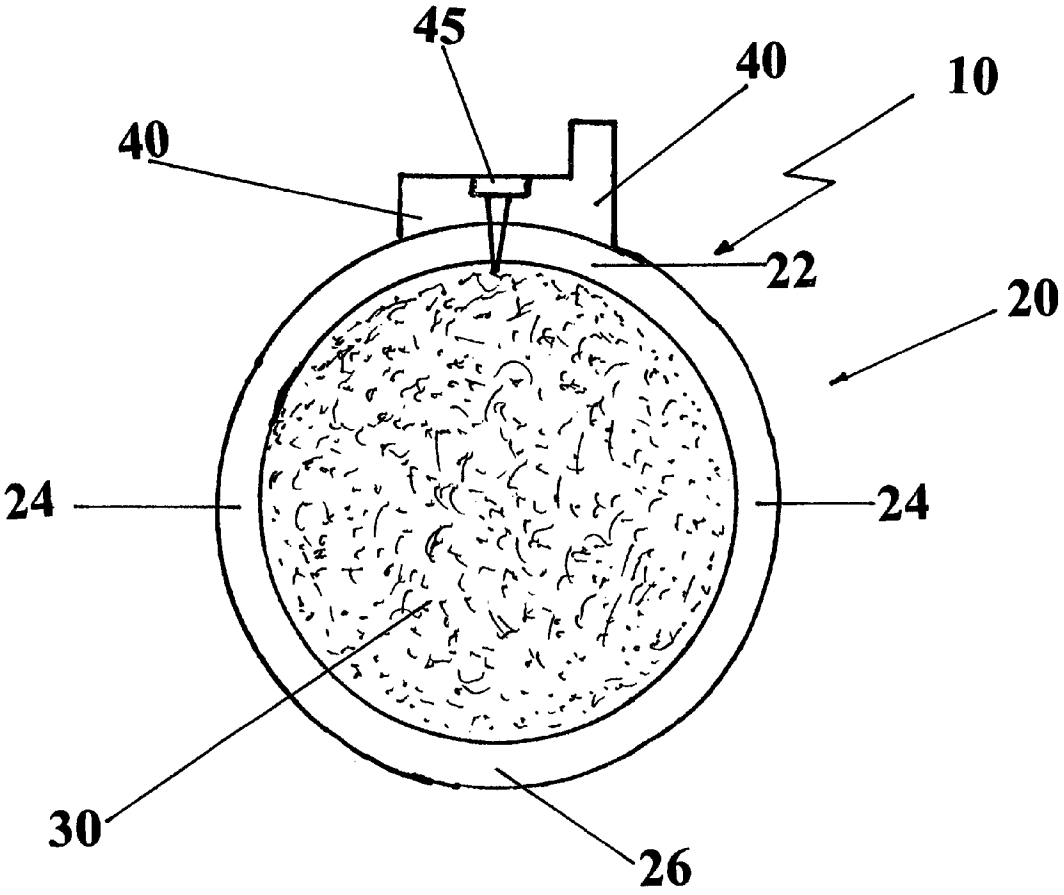
FIG. 4 is a sectional view of a second embodiment of the SR thermal break device of the present invention.

FIG. 4 provides a sectional view of a second embodiment of the SR thermal break device 10 of the present invention. The SR thermal break device 10 comprises a hollow conduit 20 fabricated from a synthetic polymeric material. In FIG. 4, the hollow conduit 20 is cylindrical in shape. The hollow conduit 20 of FIG. 4 has a top wall 22, vertical side walls 24 and a bottom wall 26. Preferably, the synthetic polymeric material is selected from the group, polyvinyl chloride, polycarbonate, fiberglass reinforced resin, and polyester. An insulating material 30 completely fills the hollow conduit 20 of the SR thermal break device 10. Preferably, the insulating material 30 comprises a polymeric foam material, such as polystyrene foam or polyurethane foam, although other insulating materials 30 can provide equivalent performance.

Preferably, a weatherstrip seal 40 is secured to the top wall 22 of the hollow conduit 20 of the SR thermal break device 10. The weatherstrip seal 40 is secured to the top wall 22 by means of a number of fasteners 45. The SR thermal break device 10 is positioned within a concrete slab C across an opening for an entry door D such that the closed door D contacts the weatherstrip seal 40 of the SR thermal break device 10.

The invention also includes a method for minimizing the transfer of heat from a building with a concrete slab floor C comprising the steps;

(a) providing a thermal break device 10 including a hollow conduit 20 fabricated from a synthetic polymeric material, the hollow conduit 20 completely filled with an insulating material 30; and (b) positioning the thermal break device 10 within a concrete slab C across an opening for an entry door D such that the closed door D contacts the thermal break device 10.

While the invention has been particularly shown and described with reference to preferred embodiments thereof, it will be understood by those skilled in the art that various changes in form and details may be made therein without departing from the spirit and scope of the invention.

I claim:

1. A thermal break device minimizing the transfer of heat from a building with a concrete slab floor, the thermal break device comprising:

a rigid, hollow conduit fabricated from a synthetic polymeric material;

an insulating material completely filling the rigid hollow conduit to produce a rigid, hollow conduit filled with said insulating material, said insulating material comprising a polymeric foam material having a thermal conductivity less than 0.02 W/m·K; and a building with a wall having an entry door in an entry opening in the wall, and having a concrete slab floor extending from within the building and beyond the entry opening in the wall, the rigid, hollow conduit filled with insulating material embedded within the concrete slab floor and extending parallel with the wall having the entry door in the entry opening in the wall and across the entry opening in the wall;

whereby the entry door positioned in the entry opening in the wall contacts the rigid, hollow conduit filled with insulating material embedded within the concrete slab floor upon the entry door in the entry opening in the wall closing.

2. The thermal break device of claim 1, wherein the hollow conduit is rectangular in cross section.

3. The thermal break device of claim 1, wherein the hollow conduit is circular in cross section.

4. The thermal break device of claim 1, wherein the synthetic polymeric material is selected from the group consisting of polyvinyl chloride, fiberglass reinforced resin, and polyester.

5. The thermal break device of claim 1, further including a weatherstrip seal secured to a top wall of the thermal break device embedded within the concrete floor, the weatherstrip seal contacting the entry door in the entry opening in the wall upon closing the entry door in the entry opening in the wall.

* * * * *